US006997337B1

(12) United States Patent
Wurster

(10) Patent No.: US 6,997,337 B1
(45) Date of Patent: Feb. 14, 2006

(54) MOLDED PLASTIC FLASK

(75) Inventor: Michael P. Wurster, Tecumseh, MI (US)

(73) Assignee: Graham Packaging PET Technologies Inc., York, PA (US)

( * ) Notice: Subject to any disclaimer, the term of this patent is extended or adjusted under 35 U.S.C. 154(b) by 174 days.

(21) Appl. No.: 10/440,707

(22) Filed: May 19, 2003

(51) Int. Cl.
*B65D 1/00* (2006.01)
*B65D 1/40* (2006.01)

(52) U.S. Cl. ..... 215/382; 215/383; 215/365; 220/669; 220/675

(58) Field of Classification Search ..... 215/379–384, 215/365; 220/669, 775; 40/310
See application file for complete search history.

(56) References Cited

U.S. PATENT DOCUMENTS

| | | | | | |
|---|---|---|---|---|---|
| 3,392,861 | A | * | 7/1968 | Dimmitt et al. | 215/307 |
| D226,174 | S | | 1/1973 | Osborn | |
| D232,158 | S | | 7/1974 | Luedtke | |
| 3,921,630 | A | * | 11/1975 | McPhee | 604/530 |
| D243,657 | S | | 3/1977 | Strand | |
| 4,387,816 | A | * | 6/1983 | Weckman | 215/381 |
| D283,598 | S | | 4/1986 | Heriard-Dubreuil | |
| 4,750,629 | A | | 6/1988 | Young | |
| 4,877,142 | A | | 10/1989 | Doering | |
| 4,946,053 | A | * | 8/1990 | Conrad | 215/381 |
| 5,092,474 | A | * | 3/1992 | Leigner | 215/381 |
| D340,864 | S | | 11/1993 | De Rothschild et al. | |
| 5,261,544 | A | * | 11/1993 | Weaver, Jr. | 215/384 |
| D367,010 | S | | 2/1996 | Moore et al. | |
| 5,908,127 | A | * | 6/1999 | Weick et al. | 215/373 |
| 5,916,646 | A | * | 6/1999 | Baudin | 428/36.1 |
| 5,918,753 | A | | 7/1999 | Ogg et al. | |
| D416,791 | S | | 11/1999 | Albrecht et al. | |
| 2002/0056696 | A1 | * | 5/2002 | Mooney | |

FOREIGN PATENT DOCUMENTS

| | | |
|---|---|---|
| EP | 399100 A1 | 11/1990 |

* cited by examiner

*Primary Examiner*—Sue A. Weaver
(74) *Attorney, Agent, or Firm*—Venable LLP; Stuart I. Smith

(57) ABSTRACT

A dual convex flask is of one-piece integrally molded plastic construction. The flask has opposed front and back walls each with a convex label panel area at a first radius of curvature and axially spaced bumpers that extend outwardly from opposite ends of the panel area. Opposed substantially flat sidewalls connect adjacent side edges of the front and back walls. The bumpers on each of the front and back walls have a second radius of curvature that is greater than the first radius of curvature, such that the bumpers have a radial depth perpendicular to the label panel area which is greatest at the ends of the bumpers adjacent to the sidewalls and least at the center of the panel area.

7 Claims, 2 Drawing Sheets

MOLDED PLASTIC FLASK

The present invention is directed to molded plastic flasks and methods of manufacture that are particularly well suited for use in vacuum filling operations.

BACKGROUND AND SUMMARY OF THE INVENTION

Flask-shaped containers are conventionally employed in some liquid product applications, such as liquor. Such flask-shaped containers have opposed relatively closely spaced front and back walls, and opposed relatively widely spaced sidewalls that interconnect the side edges of the front and back walls. Vacuum assistance is conventionally employed to increase the filling speed of liquid into containers, including flasks. Such vacuum-assisted filling involves withdrawal of air from the container interior while simultaneously injecting liquid into the interior. Vacuum-assisted filling typically does not present a problem with flask-shaped containers of glass construction, for example, because the container walls are sufficiently rigid to withstand the internal vacuum forces during and after the filling operation. However, vacuum-assisted filling can present problems with flask-shaped containers of molded plastic construction because the large front and back walls of the container can deform inwardly under the internal vacuum forces. That is, internal vacuum pressure on the relatively large front and back walls of the container tend to distort these walls inwardly. A major portion of at least the front wall, and typically both the front and back walls, of flask-shaped containers is conventionally occupied by a panel area to which a label is affixed. In some containers, particularly of molded plastic construction, ribs or bumpers are provided at the opposed upper and lower ends of the label panel area(s) to protect the label during handling of the container. These bumpers are conventionally of either uniform radial depth with respect to the adjacent label panel area, or decrease in depth toward the sidewalls of the container so as to blend into the label panel area at the sidewalls. It is a general object of the present invention to provide a flask-shaped container of molded plastic construction that has improved vacuum resistance to reduce distortion of the label panel area(s) during and after filling, and which facilitates automated handling of the containers during the fabrication and filling processes.

A flask of molded plastic construction in accordance with one exemplary but presently preferred aspect of the invention includes opposed front and back walls, at least one of which has a convex label panel area at a first radius of curvature and a pair of spaced bumpers at opposite ends of the label panel area. The bumpers have a second radius of curvature that is greater than the first radius of curvature such that the bumpers have a radial depth perpendicular to the label panel area which is greatest at the ends of the bumpers and decreases toward the center of the label panel area. This bumper contour not only increases vacuum resistance to reduce distortion of the panel area due to vacuum filling, but also improves automated handling of the containers by reducing the tendency of the container sides to overlap or "shingle" during automated handling.

A dual convex flask in accordance with an exemplary presently preferred embodiment of the invention is of one-piece integrally molded plastic construction. The flask has opposed front and back walls, and opposed substantially flat sidewalls that connect adjacent side edges of the front and back walls. The front and back walls each have a convex label panel area at a first radius of curvature and axially spaced bumpers that extend outwardly from opposite ends of the panel area. The bumpers on each of the front and back walls have a second radius of curvature that is greater than the label panel area first radius of curvature, such that the bumpers have a radial depth perpendicular to the associated label panel area which is greatest at the ends of the bumpers adjacent to the sidewalls and least at the center of the panel area.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
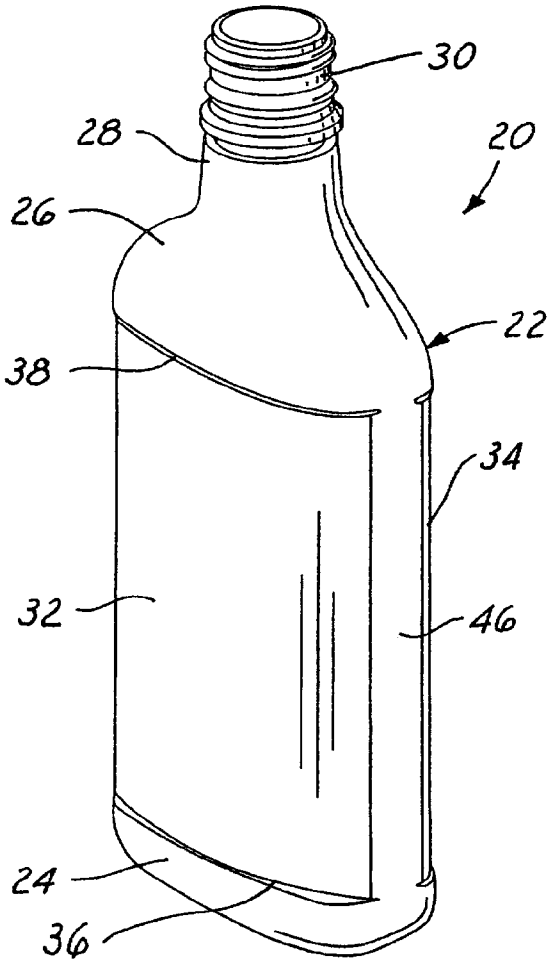
FIG. 1 is a perspective view of a flask-shaped container in accordance with one presently preferred embodiment of the invention.
Figure 2:
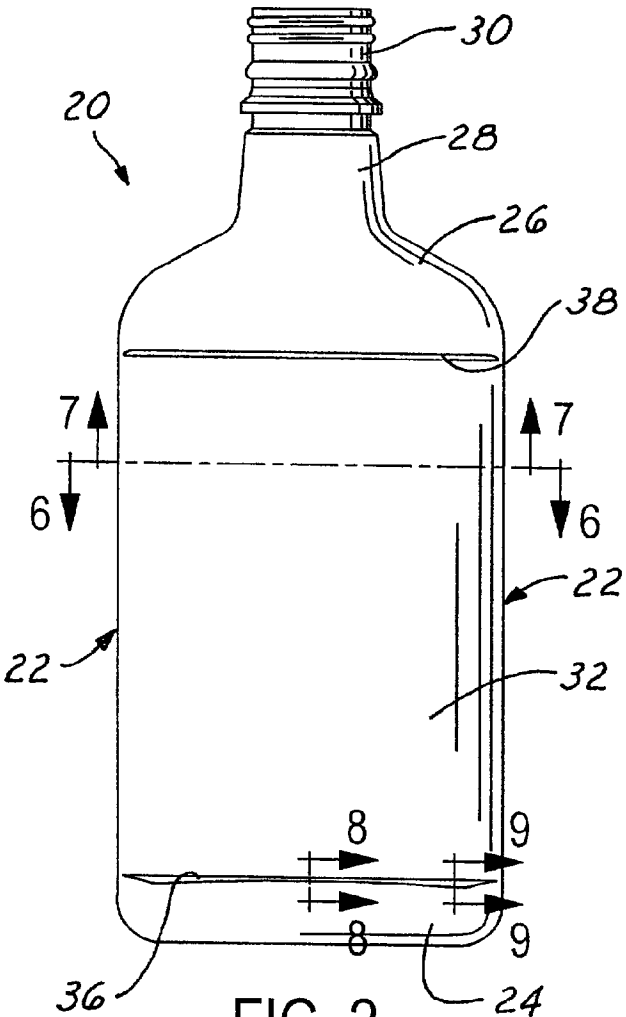
FIG. 2 is a front elevational view of the flask illustrated in FIG. 1.
Figure 3:
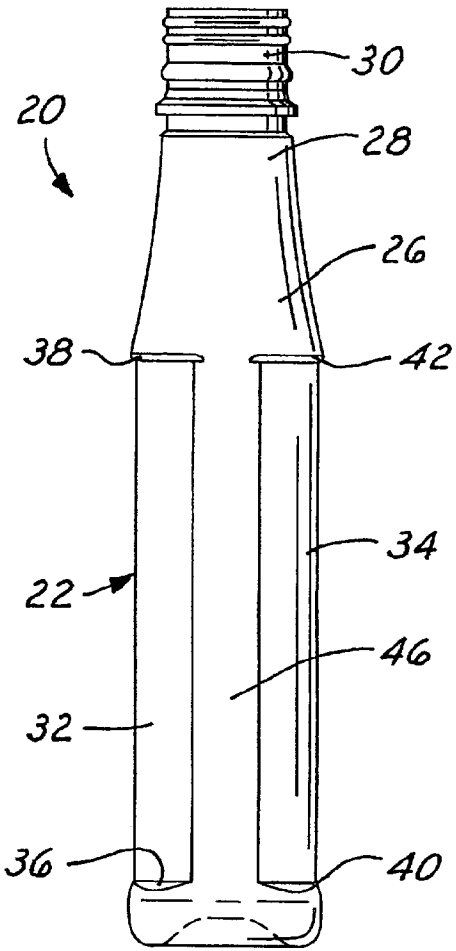
FIG. 3 is a side elevational view of the flask illustrated in FIGS. 1 and 2.
Figure 4:
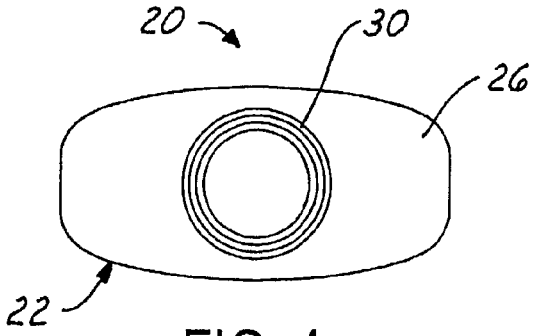
FIG. 4 is a top plan view of the flask illustrated in FIGS. 1–3.
Figure 5:
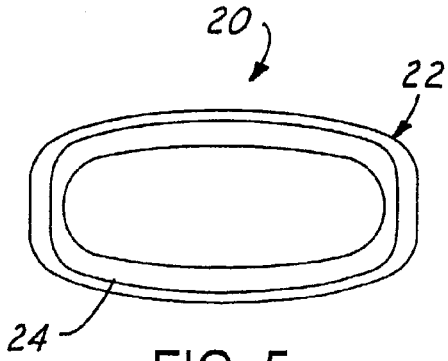
FIG. 5 is a bottom plan view of the flask illustrated in FIGS. 1–4.

The drawings illustrate a dual convex flask 20 in accordance with one presently preferred embodiment of the invention as including a body 22 having a base 24 and a shoulder 26 that narrows into a neck 28 and an externally threaded finish 30. The contours of base 24, shoulder 26, neck 28 and finish 30 are exemplary only. Container body 22 has opposed convex front and back walls in the form of front and back label panel areas 32, 34. A pair of bumpers 36,38 are provided at the respective upper and lower ends of front label panel area 32. Likewise, a pair of bumpers 40, 42 are provided at the respective upper and lower ends of back label panel area 34. Upper bumpers 38, 42 are in the form of substantially axially downwardly facing shoulders or ledges between the lower ends of shoulder 26 and the upper ends of the label panel areas. Likewise, lower bumpers 36, 40 are in the form of substantially axially upwardly facing shoulders or ledges between the upper ends of container base 24 and the lower ends of the label panel areas. The bumpers or shoulders typically are at an angle of slightly more than 90° to the adjacent panel area because of the associated mold draft angles.

Flask 20 also includes a pair of spaced sidewalls 44, 46 that extend from shoulder 26 to base 24, and integrally interconnect the adjacent side edges of front and back label panel areas 32, 34. Sidewalls 44, 46 preferably are substantially flat, which is to say that the sidewalls are flat within the limits of mold operation. The front and back walls of the container preferably are mirror images of each other, and the sidewalls of the container likewise preferably are mirror images of each other.

Figure 6:
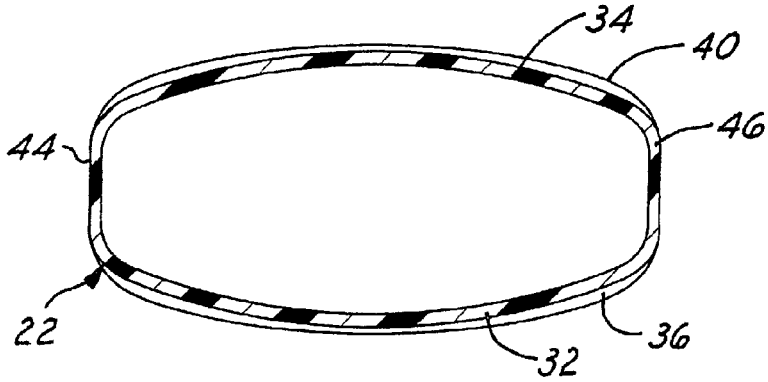
FIGS. 6 and 7 are sectional views taken substantially along the respective lines 6—6 and 7—7 in FIG. 2.
Figure 7:
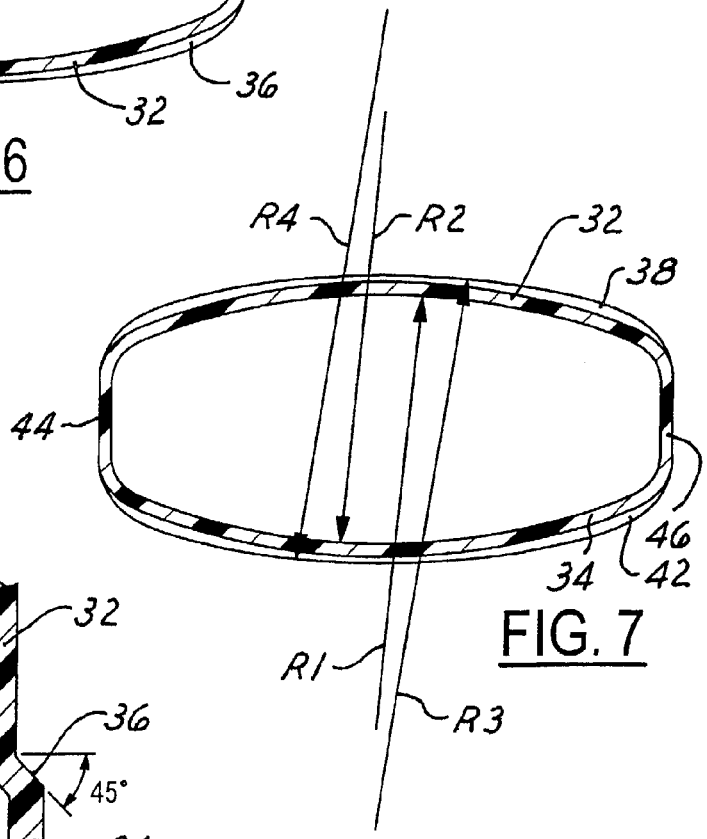
Figure 8:
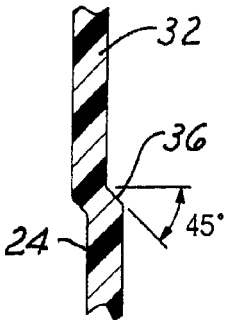
FIGS. 8 and 9 are sectional views taken substantially along the respective lines 8—8 and 9—9 in FIG. 2.
Figure 9:
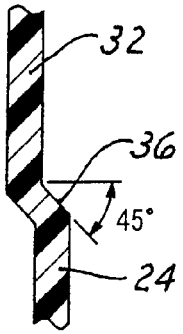

As best seen in FIGS. 6 and 7, front panel area 32 has a radius of curvature R1, which is constant throughout the width of he panel area. Likewise, back panel area 34 has a radius of curvature R2 that is constant throughout the width of the panel area. Front bumper 38 has a radius R3 that is greater than the radius R1 of front panel area 32, such that the radial depth of shoulder 38 increases from a minimum depth at the lateral center of label panel area 32 to a maximum depth adjacent to sidewalls 44, 46. Likewise, bumper 42 has a radius R4 that is greater than radius R2 of rear panel area 34, such that bumper 42 has a minimum radial depth at the center of label panel area 34 and increases to a maximum radial depth adjacent to sidewalls 44, 46. These radial depths are measured in directions perpendicular to the adjacent other label panel surface. In the preferred embodiment of the double convex flask in accordance with the present invention, radii R1, R2 are equal to each other, and radii R3, R4 are equal to each other. Radius pairs R1, R3 and R2, R4 are non-concentric. Lower bumpers 36, 40 preferably are mirror images of upper bumpers 38, 42. The wall thickness of panel areas 32, 34 and sidewalls 44, 46 preferably is substantially constant around the axis of the container, within the limitations of a blow molding operation.

In a presently preferred 200 ml flask 20 in accordance with one embodiment of the invention, the width between the outside surfaces of sidewalls 44, 46 is about 2.790 inches, the depth between the outside surfaces of shoulder 26 and base 24 is about 1.270 inches, and the axial height of label panel areas 32, 34 is about 3.438 inches. (All dimensions are nominal, and are given by way of example only.) Radii R1, R2 are equal to about 2.914 inches, and radii R3, R4 are equal to about 3.293 inches. Bumpers 36, 38, 40, 42 have a minimum radial depth of about 0.040 inch at the lateral center (between sidewalls 44, 46) of the container, and a maximum radial depth of about 0.062 inch adjacent to the sidewalls. In a 375 ml embodiment of the invention, the flask has a width between the outside surfaces of sidewalls 44, 46 of about 3.290 inches, a depth between the outside surfaces of base 24 of about 1.590 inches and an axial length of panel areas 32, 34 of about 4.304 inches. Radii R1, R2 are equal to 4.042 inches, and radii R3, R4 are equal to 4.717 inches. Bumpers 36, 38, 40, 42 have a minimum radial depth of about 0.030 inches at the lateral center of the container, and a maximum radial depth of about 0.045 to 0.050 inch adjacent to the sidewalls. The sloping faces of the bumpers are at an angle of about 45°, and the walls are of substantially uniform wall thickness in the bumper areas. All bumpers are substantially identical.

The flask-shaped container of the present invention can be fabricated employing any suitable blow molding technique, such as extrusion blow molding, injection extrusion blow molding, etc. The containers preferably are fabricated in an injection blow molding operation in which a parison is first formed in an injection molding operation, and the parison is then blow molded to the final container contour. The container may be of any suitable plastic construction, such as PET, possessing either monolayer or multilayer walls in the body and/or the finish area.

There has thus been disclosed a molded plastic flask-shaped container that fully satisfies all of the objects and aims previously set forth. Provision of bumpers having a radial depth that increases from the center to the sidewalls of the container allows the panel areas to be of smaller radius curvature, thereby increasing their resistance to distortion under internal vacuum, while enlarging and squaring the sidewall areas of the container to resist overlap and "shingling" of the container sidewalls during automated handling. The bumpers preferably have a minimum radial depth at the centers of the panel areas in a range of 0 to 0.040 inch, and a maximum radial depth adjacent to the sidewalls that is the maximum depth that can be formed and still fill the mold, preferably in the range of 0.040 to 0.065 inch for containers up to 375 ml in size. The invention has been disclosed in conjunction with two presently preferred embodiments thereof, and a number of modifications and variations have been discussed. Other modifications and variations will readily suggest themselves to persons of ordinary skill in the art. The invention is intended to encompass all such modifications and variations as fall within the spirit and broad scope of the appended claims.

What is claimed is:

1. A flask of molded plastic construction, comprising:

a side wall; and opposed front and back walls, at least one of which has a convex label panel area at a first radius of curvature and a pair of spaced bumpers on opposite ends of said label panel area, said bumpers having a second radius of curvature that is greater than said first radius of curvature, such that said bumpers have a radial depth perpendicular to said label panel area which is greatest at ends of said bumpers and decreases toward the center of said label panel areas wherein said convex label panel area extends to said side wall.

2. The flask set forth in claim 1 having laterally spaced sidewalls connecting adjacent side edges of said front and back walls, said sidewalls being substantially flat and said ends of said bumpers being disposed at said sidewalls.

3. The flask set forth in claim 2, wherein said front and back walls are mirror images of each other.

4. The flask according to claim 1, wherein said convex label panel area and said pair of spaced bumpers converge with said sidewall.

5. A dual convex flask that includes a body of one-piece integrally molded plastic construction, comprising:

opposed front and back walls each with a convex label panel area at a first radius of curvature and axially spaced bumpers that extend outwardly from opposite ends of said panel area, and opposed substantially flat sidewalls connecting adjacent side edges of said front and back walls, said bumpers on each of said front and back walls having a second radius of curvature that is greater than said first radius of curvature such that said bumpers have a radial depth perpendicular to said label panel area which is greatest at ends of said bumpers adjacent to said sidewalls and least at a center of said panel area, wherein said convex label panel area extends to said opposed substantially flat sidewalls.

6. The flask set forth in claim 5 wherein said front and back walls are mirror images of each other.

7. The flask according to claim 5, wherein said convex label panel area and said axially spaced bumpers converge with said opposed substantially flat sidewalls.

* * * * *